United States Patent [19]

Thurston

[11] 3,931,923

[45] Jan. 13, 1976

[54] BOX SECTION COVER MEMBER

[76] Inventor: Benjamin L. Thurston, 783 Great Road, Lincoln, R.I. 02865

[22] Filed: Jan. 21, 1975

[21] Appl. No.: 542,855

[52] U.S. Cl. ..... 229/23 R; 229/8; 93/36.6; 93/43

[51] Int. Cl.[2] ..... B65D 13/04

[58] Field of Search ..... 229/3.5, 5.5, 8, 23 R

[56] References Cited

UNITED STATES PATENTS

| | | | |
|---|---|---|---|
| 805,732 | 11/1905 | Kahle | 229/8 |
| 1,137,268 | 4/1915 | Kormanshaus | 229/44 R |
| 1,678,958 | 7/1928 | Schleicher | 229/8 X |
| 1,847,301 | 3/1932 | Elliott | 229/8 X |
| 1,870,688 | 8/1932 | Page | 229/8 X |
| 1,895,778 | 1/1933 | Andrews | 229/44 R X |
| 1,917,496 | 7/1933 | Claff | 229/23 R X |
| 1,959,193 | 5/1934 | Boeye | 229/23 R |
| 1,996,975 | 4/1935 | Raisin | 229/8 |
| 3,342,399 | 9/1967 | Reynolds | 229/23 R |
| 3,434,645 | 3/1969 | Prisco | 229/8 |

*Primary Examiner*—Davis T. Moorhead
*Attorney, Agent, or Firm*—Salter & Michaelson

[57] ABSTRACT

A box section and method of making same comprising an elongated strip of flexible material having a reversely bent flange along one longitudinal edge thereof, said flange defining a shoulder spaced from the opposite longitudinal edge of said strip, said strip being formed so that its opposite ends are in abutting relation whereby to define a peripheral rim with the aforesaid shoulder on the inner surface of the rim, the section further comprising a cover member of the same configuration as said peripheral rim, said cover member comprising a wall having a marginal flange extending perpendicularly therefrom, said marginal flange being inserted through the said opposite edge of said rim and being snugly received therein with the end of the marginal flange abutting the aforesaid shoulder, and means securing said cover member to said peripheral rim.

10 Claims, 12 Drawing Figures

BOX SECTION COVER MEMBER

BACKGROUND AND SUMMARY OF THE INVENTION

The present invention relates generally to a box construction, and is more particularly concerned with the construction of and method of making one of the sections of a two-section box.

Although not limited thereto, the present invention has prime utility in connection with boxes of the type used for displaying small ornamental articles, such as jewelry and the like. Boxes of this general type usually comprise a base section and a cover section, both of which may be of indentical construction. Hinge means are normally provided for hingedly attaching the two sections to each other, and frequently said hinge means are spring loaded so that the cover will normally be resiliently maintained either in a closed position or in a completely open position. Box sections of this general type are made of a variety of different materials, such as cardboard, plastic, and in some cases are provided with a metallic shell for strength purposes. Boxes of this general type, constructed of cardboard or similar material, are shown, for example, by Young, U.S. Pat. Nos. 2,648,486; 3,121,909; and 3,343,745.

Where the box sections are constructed of a relatively soft material, such as cardboard or the like, as in the above mentioned Young patents, the usual procedure is to die cut a blank of cardboard, notch it at its four corners, and then fold the four side edges of the blank inwardly to provide the side walls of the section. Means are then provided at the four corners to secure the adjacent edges of the side walls to each other. Various problems have been found to exist in cardboard box sections of this type. First of all, in order to provide sufficient strength for the box section, the cardboard must be relatively thick, thus increasing the weight and material cost of the box. In addition, problems have existed in securing the adjacent edges of the side walls to each other, and, in many cases, overlaps had to be provided whereby either the interior or exterior of the corner would not be completely smooth, thus detracting from the aesthetic appearance of the box.

It is therefore one of the primary objects of the present invention to provide a box section constructed of a soft material, such as cardboard or the like, wherein less material is required for making a structurally strong section, thus resulting in a box section that is both lighter in weight and less costly.

A further object of this invention is the provision of a box section that is constructed of cardboard or the like and that is constructed so as to be completely smooth at all of its corners.

Another object is the provision of a box section that more readily lends itself to a wide variety of ornamental features, including a combination of colors and/or materials, etc.

In carrying out the aforesaid objectives, I provide a box section that is made up of two separate components, i.e., a peripheral rim and a cover member. The rim is formed from an elongated strip of cardboard or the like which is cut to the desired length and is then scored longitudinally to provide a fold line for reversely bending a longitudinal flange against one surface of the strip. Before this bending operation is performed, the strip is scored transversely to define the fold lines for the corners of the rim, and the longitudinal flange is notched adjacent the score lines so that when the flange is bent upwardly against the surface of the strip, and the strip is folded at the aforesaid transverse score lines, there will be sufficient clearance at the corners for the reversely bent flange. After the reversely bent flange has been folded against and secured to a surface of the strip, the strip is folded to define a peripheral rim, with the ends of the strip in abutting relation, said ends preferably being located intermediate one of the sides of the rim rather than at a corner thereof, although this is not essential. It will thus be seen that the reversely bent flange defines a shoulder along the inner surface of the rim, which shoulder is spaced from the opposite longitudinal edge of the rim. The cover member is nothing more than a cardboard blank notched at its corner and having side wall portions inwardly folded along its edges, said side wall portions being snugly received within the peripheral rim, with the edges of said side wall portions abutting the aforesaid shoulder. After the cover member has been inserted into the rim, means are provided for securing said cover member to said rim to said rim to complete the assembly.

By constructing the box section in the foregoing manner, the rim portion may be made of somewhat thinner cardboard stock than would normally be employed for a cardboard box section, since the reversely bent flange imparts additional strength to the rim. In addition, the cover member may be made of substantially thinner cardboard stock, since it is the rim portion which actually imparts structural rigidity to the box section. Obviously, the rim portion and cover member may be covered with any ornamental sheet material; and since the rim portion and cover member are separate elements prior to assembly, they may be covered with different materials and/or different-color materials in order to provide interesting two-tone effects to the assembled box section.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
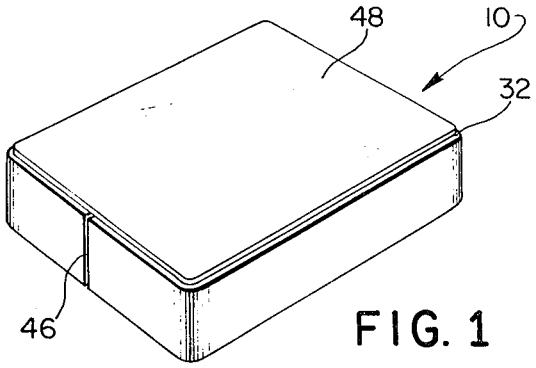
FIG. 1 is a perspective view of a box section constructed in accordance with my invention.
Figure 2:
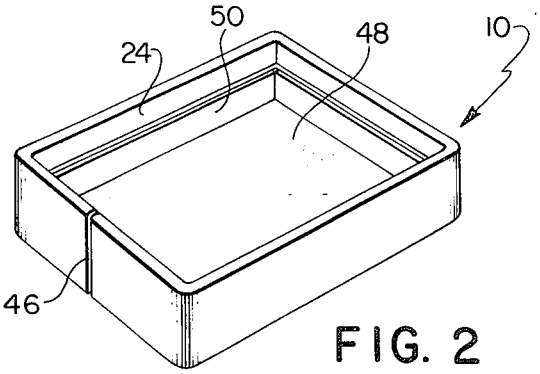
FIG. 2 is a perspective view showing the interior of the box section of FIG. 1.
Figure 3:
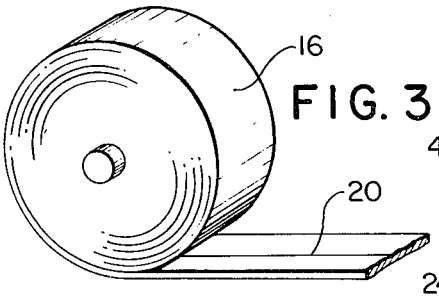
FIG. 3 is a perspective view illustrating a roll of strip material from which the rim portion which forms a part of the box section is constructed.
Figure 12:
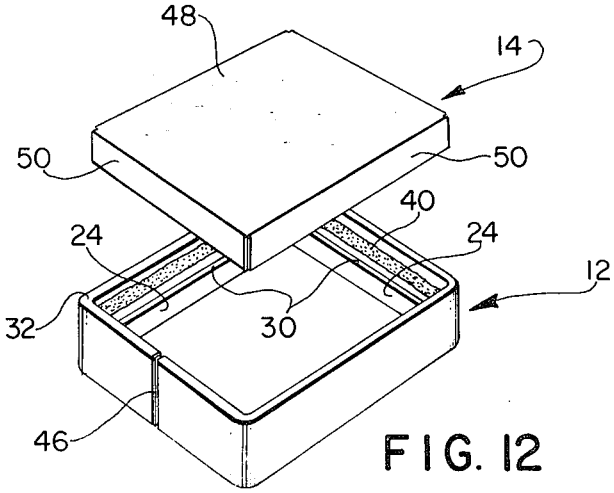
FIG. 12 is an exploded perspective view illustrating the orientation of the cover member and rim portion just prior to assembly thereof.

Referring now to the drawings, and more particularly to FIGS. 1, 2 and 12, there is shown generally at 10 a box section comprising a peripheral rim portion shown generally at 12 and a cover member shown generally at 14, all preferably constructed of a soft flexible material, such as cardboard or the like. The rim portion 12 is preferably formed by cutting a roll of cardboard strip 16 (FIG. 3) into blanks 18 of a predetermined length. The blanks 18 are longitudinally scored as at 20 and are laterally scored as at 22. As will be noted, longitudinal score line 20 defines a longitudinally extending flange 24, which flange is notched as at 26 in alignment with each of the transverse score lines 22.

Figure 4:
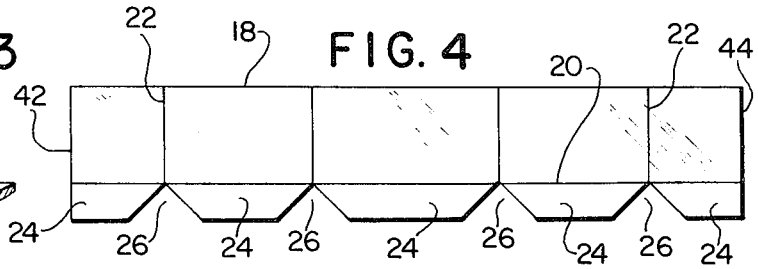
FIG. 4 shows a die-cut and scored blank from which the peripheral rim is formed.
Figure 5:
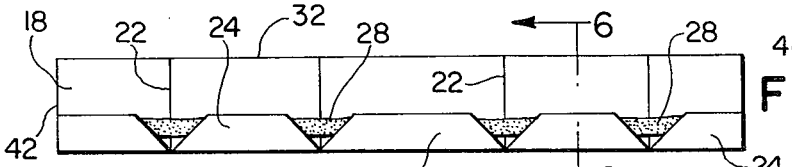
FIG. 5 shows the blank of FIG. 4 after the longitudinal flange has been reversely bent and secured.
Figure 6:
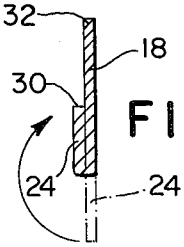
FIG. 6 is a section taken on line 6—6 of FIG. 5.

After the blank 18 has been cut, scored and notched as illustrated in FIG. 4, the next step is to apply a continuous bead of heat-fusible adhesive 28 a short distance above fold line 20, after which the longitudinal flanges 24 are reversely bent, as illustrated in FIGS. 5 and 6, until they engage the surface of blank 18, at which point heat is applied to securely attach said flanges to said surface. As will be noted, the upper edges of flanges 24 define a shoulder 30, which shoulder is in spaced relation to opposite longitudinal edge 32 of strip 18.

Figure 7:
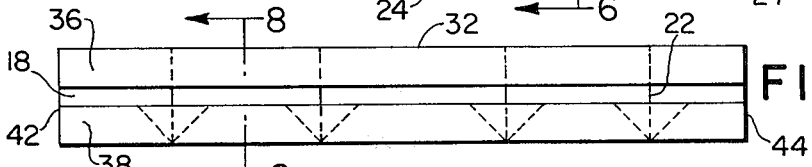
FIG. 7 shows the strip of FIG. 5 after a layer of ornamental sheet material has been secured thereto.
Figure 8:
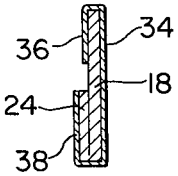
FIG. 8 is a section taken on line 8—8 of FIG. 7.
Figure 10:
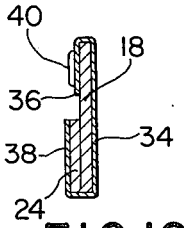
FIG. 10 is a section taken on line 10—10 of FIG. 9.
Figure 9:
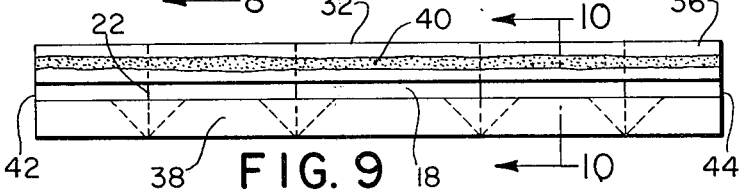
FIG. 9 shows the strip of FIG. 7 after a bead of adhesive has been applied.
Figure 11:
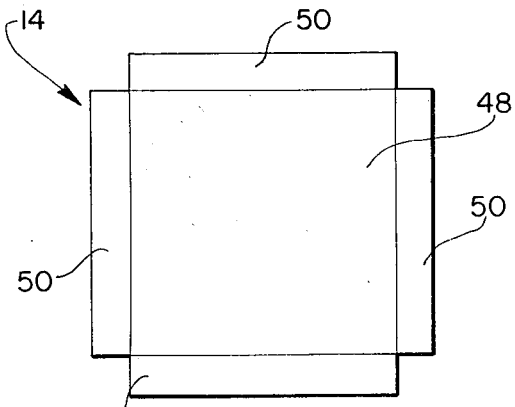
FIG. 11 shows the blank from which the cover member is formed.

The next step, illustrated in FIGS. 7 and 8, is to cover the strip 18 with an ornamental layer or sheet 34, which sheet may be any suitable ornamental material, such as an embossed plastic sheet, paper cloth, etc. On its inner surface, the sheet 34 is provided with a heat-fusible layer whereby when the sheet 34 is wrapped around the strip 18, as illustrated in FIGS. 7 and 8, it may be secured thereto by the application of heat. It will be noted that sheet 34 covers the entire outer surface of strip 18 and then folds around at opposite longitudinal edges of the latter, as at 36, 38 to cover a substantial part of the inner surface of the strip. After the sheet 34 has been affixed to strip 18, as indicated, a further bead of heat-fusible plastic 40 is applied and extends longitudinally along portion 36, as illustrated most clearly in FIGS. 9 and 10. At this point, the strip 18 is folded along score lines 22 to define the peripheral rim illustrated at 12 in FIG. 12. When so folded, it will be understood that the score lines 22 define the four corners of the rim, and the opposite ends 42, 44 of the strip 18 abut each other as at 46 intermediate one of the walls of the rim portion, preferably the rear wall thereof.

The cover member 14 is die cut or otherwise formed to include a wall or cover 48 having the same configuration as that defined by rim portion 12. The wall 48 is provided with integral marginal flanges 50 at its four sides, which flanges are adapted to be bent substantially perpendicular to the plane of wall 48, as shown most clearly in FIG. 12. The cover member 14 is then inserted into end 32 of rim portion 12 until the edges of flanges 50 engage and abut shoulder 30, it being understood that cover member 14 is dimensioned so that flanges 50 are snugly received by rim portion 12. Once the cover member 14 has been so positioned within rim portion 12, heat is applied to the side walls of the latter to fuse and secure the cover member into assembled relation with respect to rim portion 12, as illustrated in FIGS. 1 and 2. As will be noted, the depth of flanges 50 is substantially equal to the spacing between shoulder 30 and edge 32, whereupon when cover member 14 is assembled to rim portion 12, wall 48 is substantially adjacent to edge 32 or perhaps very slightly elevated with respect thereto.

It will be understood that the notches 26 permit the flanges 24 to properly engage each other at the corners of rim portion 12 in the same way that the notches at the corners of cover member 14 permit the edges of flange 50 to properly engage each other when said flanges are folded perpendicularly from wall 48. The ornamental covering 34 which covers strip 18 enhances the appearance of box section 12 since all exposed parts of rim portion 12 are covered. It will be understood, of course, that cover member 14 may also be covered with any desired ornamental sheet material or may be otherwise ornamented as desired. Since the rim portion 12 and cover member 14 are entirely separate and distinct elements before their assembly, it follows that they may be covered with different ornamental sheet material or with the same material having different colors in order to provide interesting and decorative two-tone effects.

It will be understood that the box section 10 readily lends itself to automatic manufacture, since automatic machinery can be provided for cutting, scoring and notching the strip 18, as well as for applying the bead of adhesive 28 and then folding the flanges 24 into engagement with said bead. Likewise, the application of ornamental sheet 34 can be easily effected by automatic equipment, after which adhesive bead 40 may be automatically applied, and then the automatic equipment would be effective to fold the rim portion into the position illustrated in FIG. 12 and maintain it so positioned. At the same time, the cover member 14 is automatically die cut and folded, moved into alignment with rim portion 12, and inserted therein to complete the automatic assembly.

One of the advantages of the present construction is the fact that the cardboard strip 18 does not have to be as thick as the cardboard stock used previously for cardboard box sections, since the folded-over flanges 24 impart additional rigidity to the rim portion 12, and, in addition, longitudinally extending adhesive beads 28 and 40 add further rigidity to the rim. The cover member 14 may be of relatively thin cardboard stock also, since the wall 48 does not actually perform a structural function. As will be noted, rim portion 12 actually comprises a double thickness of the cardboard, since the portion of strip 18 that is not covered by bent-over flanges 24 is fortified by abutment with flanges 50 of the cover member. It has been found that the box section 10 may be in the range of 20 to 25 per cent lighter in weight than a comparable cardboard box section of the type conventionally used in the prior art without sacrificing any structural strength. This lighter weight is not only desirable from the standpoint of handling the box sections, but also results in a material saving, which reduces the cost of the box section, as compared to the prior art. Also, the smooth, unencumbered corners which exist in the rim portion of my box have proven to be advantageous over the prior-art construction wherein overlapping or other means of securement must be provided at each corner of the box. The present invention more readily lends itself to being covered with materials such as velvet and the like, because of this fact; and, of course, it is also now possible to cover only the cover member of the box with such material, if desired. Although the box section 10 is shown in the drawings as being of rectangular configuration, it will be understood that this invention may be used in connection with other configurations as well.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A box section comprising a rim portion constructed of an elongated flat strip having its ends in abutting relation, said strip being formed to assume the desired configuration of the box section and defining the side walls thereof, said strip having flange means reversely bent along a longitudinal edge thereof, said flange means abutting the inner surface of said rim portion and terminating in spaced relation to the opposite longitudinal strip edge so as to define a shoulder on said inner side wall surface, and a separate cover member comprising a wall having the same configuration as that defined by said rim portion, said wall having a marginal flange extending into said rim portion from said opposite edge and being snugly received therein, the free edge of said marginal flange abutting against said shoulder, the depth of said marginal flange being substantially equal to the spacing between said shoulder and said opposite edge, whereby said wall is located adjacent said opposite edge and closes the adjacent end of said rim portion, and means securing said cover member to said rim portion.

2. The box section of claim 1 further characterized in that said rim portion and said cover member are both of cardboard construction.

3. The box section of claim 2 further characterized in that said rim portion flange extends for substantially the entire length of said strip, and means securing said rim portion flange against the inner surface of said strip.

4. In the box section of claim 3, said means securing said cover member to said rim portion and securing said rim portion flange against said inner surface both comprising a longitudinal bead of heat-fusible adhesive.

5. The box section of claim 3 further characterized in that said strip is formed with four corner folds whereby to define a rectangular configuration.

6. The box section of claim 3 further characterized in that said strip has a covering extending over the entire outer surface thereof, and means securing said covering to said strip.

7. The method of making a box section comprising the following steps:

A. cutting and scoring an elongated strip of flexible material;

B. folding a flange along one longitudinal edge of said strip and securing said folded flange against the adjacent surface of said strip to provide a longitudinally extending shoulder in spaced relation to the opposite longitudinal edge of said strip;

C. forming said strip so that its opposite ends are in abutting relation to define a peripheral rim with said shoulder located on the inner surface thereof;

D. forming a cover member having the same configuration as said peripheral rim;

E. folding marginal flanges along the edges of said cover member substantially perpendicular thereto, said cover member being dimensioned so as to snugly fit within said peripheral rim;

F. inserting said cover member into said opposite edge of said rim until the end of said marginal flanges abut said shoulder; and G. securing said cover member to said rim.

8. The method of claim 7 further characterized in that said strip and cover member are both constructed of cardboard.

9. The method of claim 8 further characterized in that the depth of said marginal flanges is substantially equal to the spacing between said shoulder and said opposite longitudinal edge.

10. The method of claim 8 further characterized in that after Step B is performed, a covering is secured to said strip completely overlying the surface thereof opposite from said adjacent surface.

* * * * *